US005083300A

United States Patent [19]

Schwartz

[11] Patent Number: 5,083,300

[45] Date of Patent: Jan. 21, 1992

[54] SETTING MECHANISM FOR A TIMEPIECE

[75] Inventor: Herbert Schwartz, Wurmberg, Fed. Rep. of Germany

[73] Assignee: Timex Corporation, Middlebury, Conn.

[21] Appl. No.: 727,706

[22] Filed: Jul. 10, 1991

[51] Int. Cl.[5] ..... G04B 18/00; G04B 27/02

[52] U.S. Cl. ..... 368/185; 368/190

[58] Field of Search ..... 368/34–35, 368/185, 190–195

[56] References Cited

U.S. PATENT DOCUMENTS

| | | | |
|---|---|---|---|
| 3,360,922 | 1/1968 | Rogers | 368/35 |
| 3,828,546 | 8/1974 | Saito et al. | 368/35 |
| 3,866,407 | 2/1975 | Wuthrich | 368/35 |
| 4,853,909 | 8/1989 | Shoji et al. | 368/190 |

*Primary Examiner*—Vit W. Miska
*Attorney, Agent, or Firm*—William C. Crutcher

[57] ABSTRACT

An improved setting mechanism for a timepiece of a known type having a frame, a gear train, a detented setting stem rotatably mounted and axially slidable in the frame and having a toothed setting pinion which is engageable and disengageable with a plurality of crown teeth arranged on one of the gear train members, the stem setting pinion being arranged on a first axis and the crown tooth gear being arranged on a second axis. The improvement comprises offsetting the first axis so that it does not intersect the second axis and skewing the crown teeth in the direction of offset so that the setting pinion engages the crown teeth from a non-radial direction to facilitate engagement on only one side of the pinion. The offset further facilitates a stem extension in a non-interfering position.

7 Claims, 3 Drawing Sheets

SETTING MECHANISM FOR A TIMEPIECE

This invention relates generally to a setting mechanism for a timepiece and, more particularly, to a manually actuated setting mechanism of the type having a stem with a setting gear which is adapted to be engaged with one of the gears of the timepiece gear train in order to manually rotate the timesetting hands.

BACKGROUND OF THE INVENTION

Timepiece setting mechanisms are well known for timepieces having a train of gear members, wherein a manually actuated stem is moved from a detented disengaged position so that a stem setting pinion on the stem engages crown teeth arranged on one of the gear members when the stem is in a second detented position. Subsequently, the stem setting pinion and stem may be rotated by a watch crown exterior to the timepiece case. Such stem setting mechanisms have long been known in mechanical or spring driven timepieces and are used as well in electronic timepieces of the "analog type". The latter incorporate a stepping motor driven by pulses from an integrated circuit having a quartz oscillator time base.

One problem in the prior art, especially in the case of quartz analog wristwatches where the gear with crown teeth resist rotation due to holding torque of the stepping motor, is the possibility of damaging the meshing gear teeth at the time of engagement. In order to avoid this possibility, the engaging teeth have sometimes been bevelled or relieved on the engaging side of either the stem setting pinion or the crown gear to facilitate engagement by forcing a slight rotation of either the stem setting pinion or the crown gear as the gears are engaged. Examples of detented manually actuated stems with a stem setting pinion on the stem arranged to engage or disengage crown gear teeth are shown by way of example in U.S. Pat. No. 3,360,922, issued Jan. 1968 to D. J. Rogers and U.S. Pat. No. 3,866,407, issued Feb. 18, 1975 to Wuthrich, the latter assigned to the applicant's assignee.

In the case of the prior art stem setting mechanisms, it has been the conventional practice to arrange the stem setting pinion axis to intersect the crown gear axis, thereby moving the stem in a radial direction with respect to the crown gear. For some timepieces, it is desirable to support the stem by an extension which is suitably supported in the frame. If the crown gear has a small diameter, the stem extension and its supporting means is likely to interfere with the crown gear spindle.

Accordingly, one object of the present invention is to provide an improved setting mechanism for a timepiece which reduces possibility of damaging the setting gears at the time of engagement Another object of the invention is to provide an improved arrangement for a stem setting mechanism employing a stem extension support.

Still another object of the invention is to provide an improved setting mechanism for a quartz analog timepiece when the minute wheel includes a set of crown teeth engaged by a stem setting pinion on an axially slidable, rotatable, detentable, manually actuated stem.

DRAWINGS

The invention, both as to organization and method of practice, together with further objects and advantages thereof, will best be understood by reference to the following specification, taken in connection with the accompanying drawings in which.

SUMMARY OF THE INVENTION

Briefly stated, the invention comprises an improved setting mechanism for a timepiece of a known type having a frame, a gear train, a detented setting stem rotatably mounted and axially slidable in the frame and having a toothed stem setting pinion which is engageable and disengageable with a plurality of crown teeth arranged on one of the gear train members, the stem setting pinion being arranged on a first axis and the crown tooth gear being arranged on a second axis. The improvement comprises offsetting the first axis so that it does not intersect the second axis, and skewing the crown teeth in the direction of offset so that the stem setting pinion engages the crown teeth from a non-radial direction to facilitate engagement with the pinion teeth on only one side of the pinion.

DESCRIPTION OF THE PREFERRED EMBODIMENT

Figure 1:
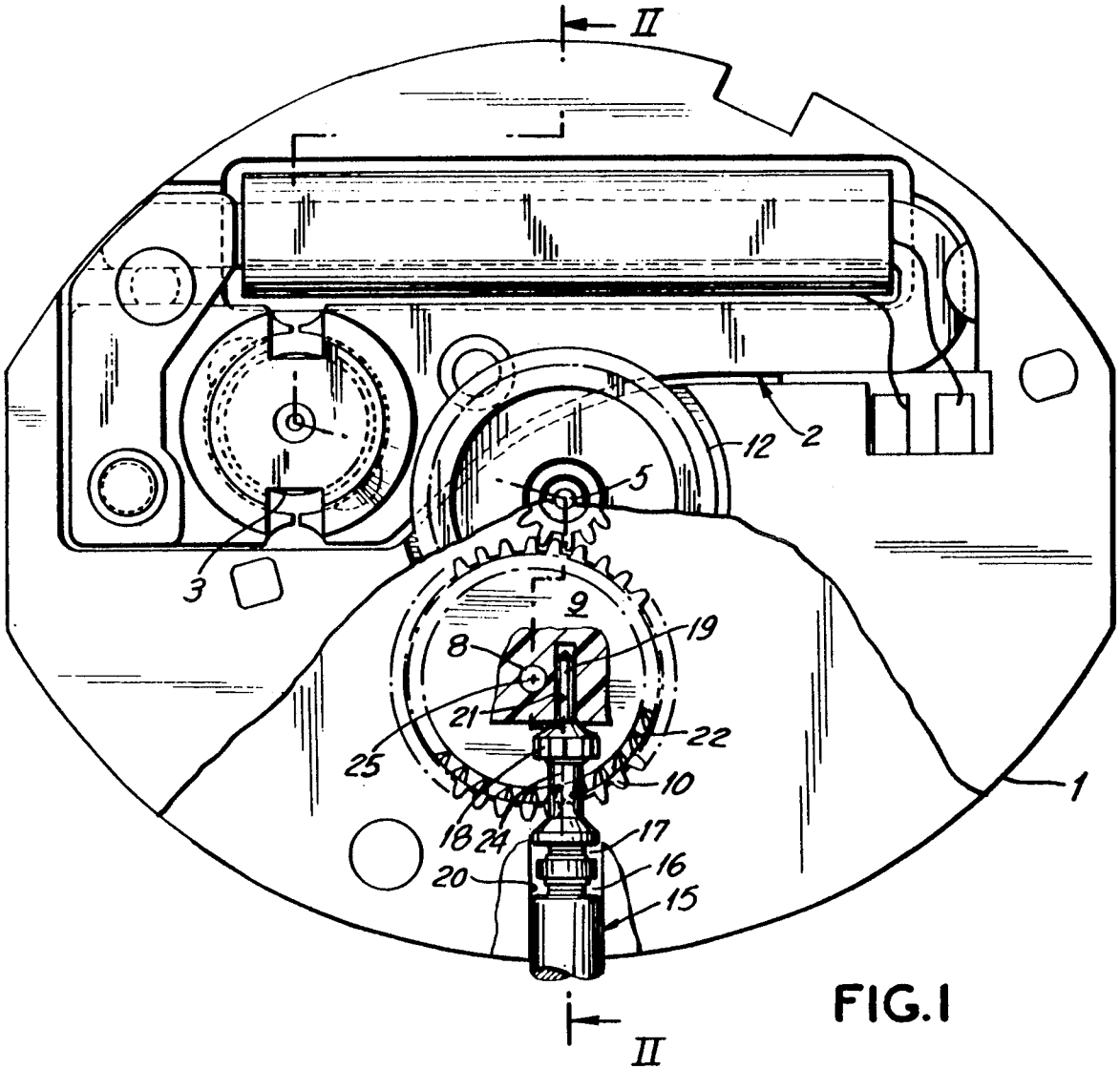
FIG. 1 is a top plan view of the improved setting mechanism looking from the dial side along lines I—I of FIG. 2, with dial and other portions of the frame removed for clarity.
Figure 2:
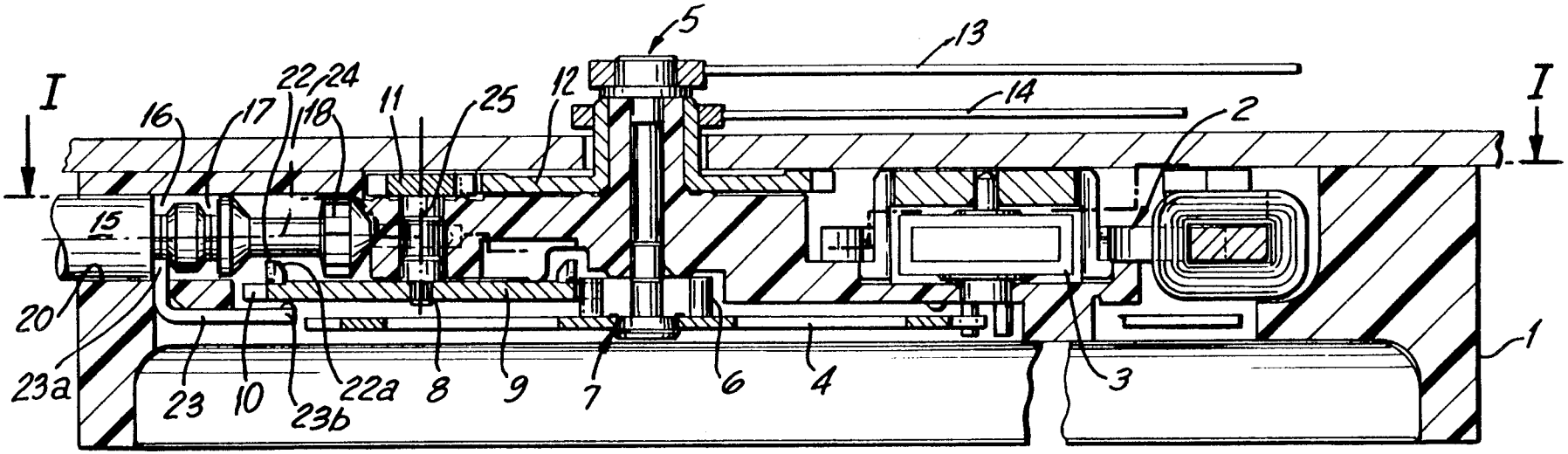
FIG. 2 is a developed, cross-sectional, side elevational view taken along lines II—II of FIG. 1.

Referring now to FIGS. 1 and 2 of the drawing, the movement is supported in an integral plastic frame member, molded as a single piece and having an intricate shape of high precision. FIG. 1 is a plan view from the top (dial side) with the dial and portions of the frame removed (as indicated along lines I—I of FIG. 2) to show the setting mechanism which is the subject of the present invention. A stepping motor, the details of which are not material to the present invention is shown generally at 2 and includes a rotor assembly 3. Referring to the elevational view of FIG. 2, the stepping motor rotor assembly 3 drives a center wheel 4 mounted on a center staff 5. The center staff 5 includes a center pinion 6 affixed thereto, but which is arranged to slip at a friction connection indicated as 7.

A minute wheel assembly is mounted on a spindle 8 which is rotatably journaled in frame 1. The minute wheel assembly comprises a minute wheel 9 with spur teeth 10 on its outer periphery meshing with the teeth of center pinion 6. The minute wheel assembly further includes a minute pinion 11 driving a hour wheel 12 which is rotatably disposed in the frame coaxially with center staff 5. Center staff 5 supports a minute hand 13 and hour wheel 12 supports an hour hand 14. Thus, the gear members 4, 6, 9, 11 and 12 together make up a gear train driven by the stepping motor 2 to step the hour hand and minutes hands 13, 14 of the timepiece in a manner well known in the art.

In order to set the timepiece hands to correct the time, a setting mechanism comprises a stem shown generally as 15. Stem 15 includes a manual setting crown (not shown) external to the watch case, axial detent grooves 16, 17, a stem setting pinion 18 and a stem extension 19 on the end opposite the manual actuator. Stem 15 is mounted to be axially slidable and rotatable within frame 1 by means of a first bore 20 in the frame housing the larger diameter portion of the stem and a second bore 21 housing the stem extension 19.

Disposed on the minute wheel 9 so as to be engaged by the stem setting pinion 18 when it is moved in an axial direction are a plurality of crown teeth 22 which are generally perpendicular to the spur teeth 10.

The stem 15 is axially slidable along a first axis and is held in one of two detented positions either an "engaged" position or a "disengage" position, by means of a holding spring 23, which is supported by means not material to the present invention to permit it to move in the direction shown by the arrow. The holding spring includes a detenting element 23*a* which enters either of the grooves 16, 17, and a support extension 23*b* which provides a yieldable support beneath minute wheel 9 to facilitate engagement of the stem setting pinion 18 with the crown teeth 22.

In accordance with the present invention, the stem 15 is arranged to rotate and slide along a first axis 24, and the minute wheel assembly is arranged to rotate on spindle 8 about a second axis 25 which, in contrast to the prior art, does not make a perpendicular intersection with axis 24. Instead, the first axis 24 is offset to one side from axis 25 so that, although, their projections are mutually perpendicular, the axes are not intersecting with one another. By offsetting the first axis a sufficient amount from the second axis, the stem extension 19 and the minute wheel spindle 8 do not interfere, thereby permitting the stem extension 19 to extend beyond the minute wheel axis so as to provide a stable support for the end of the stem 15.

Figure 3:
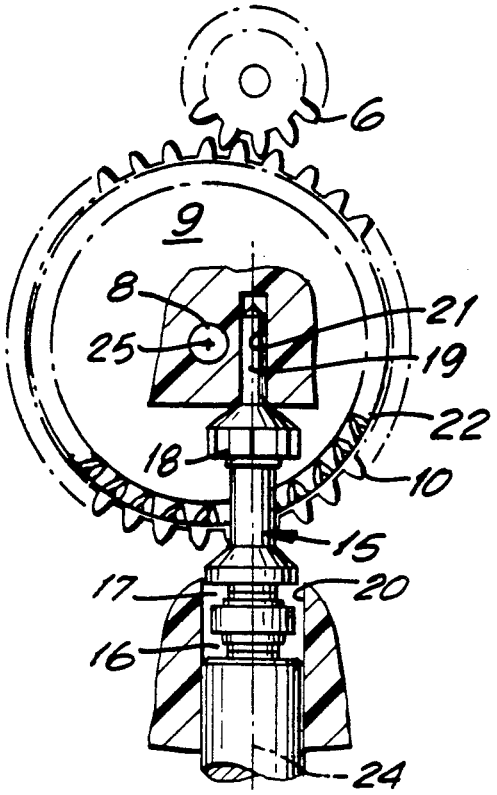
FIG. 3 is an enlarged partial top plan view of the movement looking from the dial side in the vicinity of the stem setting mechanism, showing the stem setting pinion disengaged.
Figure 4:
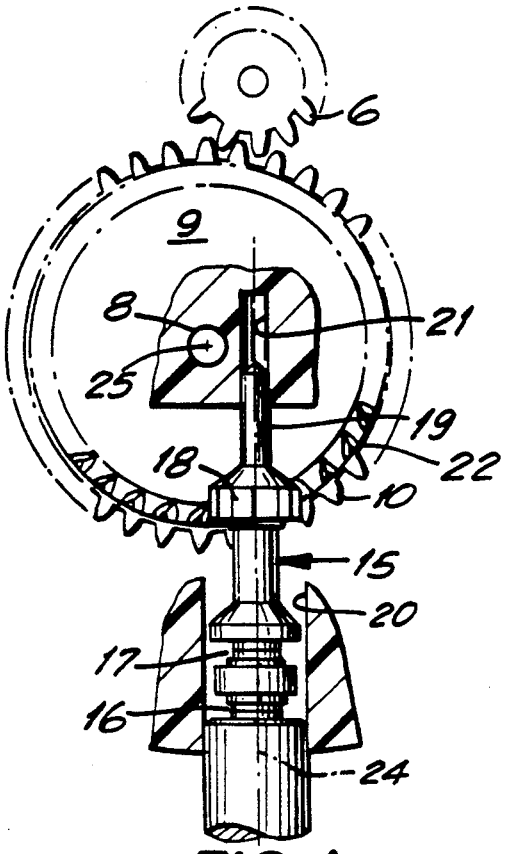
FIG. 4 is a view similar to FIG. 3 showing the stem setting pinion engaged with the minute wheel.

Referring now to FIGS. 3 and 4 of the drawing, the elements are shown from the dial side with the same numbers as previously assigned, but without the extraneous elements, so as to simplify the explanation of the advantages of the invention. In FIG. 3, the stem 15 is shown in a first axially detented disengaged position as in FIGS. 1 and 2 of the drawings. FIG. 4 shows the stem 15 in a second axially detented position with the stem setting pinion 18 engaged with crown teeth 22. In the latter position, manual rotation of the stem 15 will rotate the minute wheel 9 and through it the pinion 6 thereby turning both minute 13 and hour hand 14 to set the timepiece, a friction slip being provided at 7 as shown in FIG. 2.

According to the prior art, axial movement of the stem was along an axis which intersected with the minute wheel axis. This gave both opposite sides of the setting gear pinion 18 equal possibilities of hitting an interfering edge of a crown tooth and possible breakage. With the offset shown in FIGS. 1, 3 and 4, the teeth on the right hand side of the setting gear pinion 18 are closer to the crown teeth 22 than those on the left hand side. This assures that if there happens to be an interference, it will occur on the right hand side, where the teeth will intersect and move the minute wheel slightly to facilitate engagement. This is further facilitated by skewing the ridges of the crown teeth out of their customary radial direction as will be explained in connection with FIG. 5 of the drawing.

Figure 5:
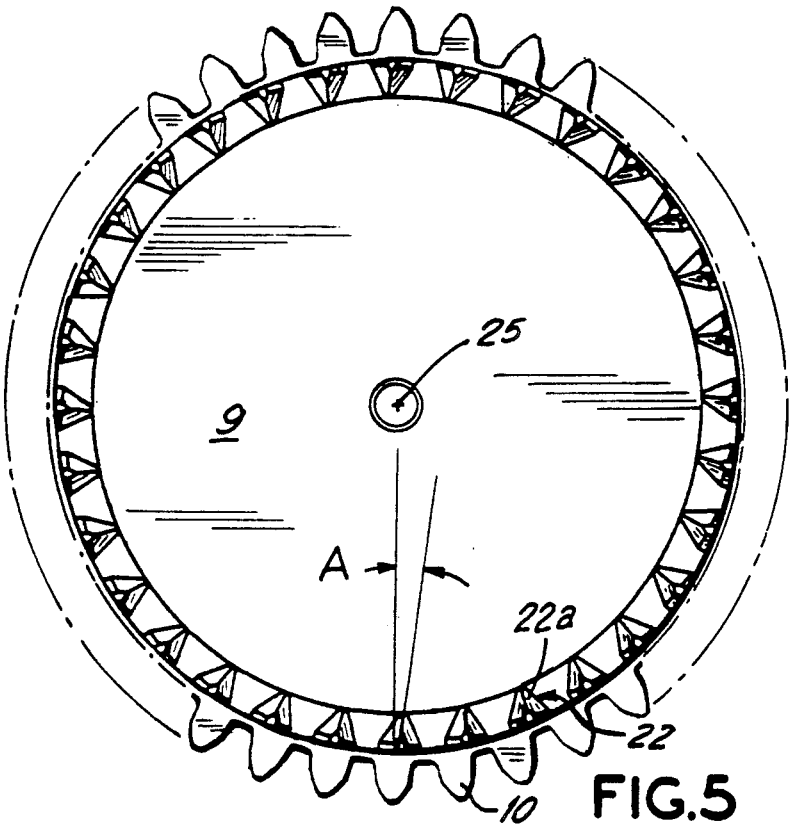
FIG. 5 is a further enlarged top plan view of the minute wheel illustrating the arrangement and orientation of the crown teeth on the minute wheel.

Referring to FIG. 5, it will be seen that crown teeth 22 are bevelled on the surfaces 22*a* and also are narrower at the inner diameter than they are at the outer diameter. This is already known in the prior art. However, contrary to the prior art, the center lines or ridges of the crown teeth 22*a* have been skewed away from the radial direction by a preselected angle A. The angle of skew is selected so as to provide alignment with the teeth of the setting gear pinion which is also offset from axis 25 as previously described. The optimum angle will vary with number of teeth, diameter of the minute wheel, number of teeth on the stem setting gear, pitch diameter of the stem setting gear and so forth.

In the movement depicted, with 32 crown teeth on the minute wheel and 7 teeth on the stem setting pinion, having pitch diameters of 3.3 mm. and 0.721 mm. respectively, the selected skew angle A is approximately 5 and ½ degrees. Although, the skewing of the crown teeth results in a complex tooth shape, the manufacture of skewed crown teeth is readily accomplished by conventional gear hobbing techniques.

While the arrangement disclosed in the drawings uses a minute wheel assembly consisting of pinion 11, spindle 8 and minute wheel 9, other arrangements within the scope of the invention would use a minute wheel 9 rotatably mounted on a short stub which is part of the frame member. The benefits of the offset are again achieved in terms of reducing possibility of interference on both sides of the stem setting pinion as previously described.

While there has been described what is at presently considered to be the preferred embodiment of the invention, other modifications will occur to those skilled in the art, and it is desired to secure in the appended claims all such modifications as fall within the true spirit and scope of the invention.

I claim:

1. A setting mechanism for a timepiece having a frame and a gear train comprising a plurality of meshing gear members rotatably disposed in said frame, said setting mechanism comprising a setting stem rotatably mounted and axially slidable in said frame along a first axis, including a stem setting pinion thereon, detent means adapted to hold said setting stem in engaged and disengaged axial positions and a toothed wheel included among said meshing gear members of said gear train, said toothed wheel being rotatably mounted in said frame about a second axis and having a plurality of crown teeth arranged to mesh with said stem setting pinion when the setting stem is in the engaged position, wherein the improvement comprises, said first axis being arranged so that it is offset from said second axis to be non-intersecting therewith, and said crown teeth being skewed by a preselected angle away from the radial direction on said toothed wheel, whereby engagement of the stem setting pinion with the crown teeth is facilitated.

2. The improvement according to claim 1, wherein said setting stem includes a stem extension disposed along said first axis, said frame defining a bore housing said stem extension, whereby the end of the setting stem is supported by the frame.

3. The improvement according to claim 1, wherein said setting stem includes a stem extension disposed along said first axis, said frame defining a bore housing said stem extension, and wherein said toothed wheel is mounted on a spindle extending along said second axis, said stem extension being arranged to move past said spindle second axis without interfering with said spindle when the stem is moved axially in said frame.

4. The improvement according to claim 1, wherein said setting stem includes a pair of detenting grooves, wherein said detent means comprises a spring biased detent portion arranged to enter said grooves and a yieldable support portion disposed on the side of said toothed wheel opposite said crown teeth said yieldable support portion being adapted to support the toothed wheel during engagement of the stem setting pinion.

5. The improvement according to claim 1, wherein said stem setting pinion is disposed between said second axis and said crown teeth.

6. The improvement according to claim 1, wherein said preselected angle of skew is on the order of $5\frac{1}{2}°$.

7. A setting mechanism for a timepiece having a frame and a gear train comprising a plurality of meshing gear members rotatably disposed in said frame, said setting mechanism comprising a setting stem rotatably mounted and axially slidable in said frame along a first axis, including a stem setting pinion thereon, detent means adapted to hold said setting stem in engaged and disengaged axial positions and a toothed wheel included among said meshing gear members of said gear train, said toothed wheel being rotatably mounted in said frame about a second axis and having a plurality of crown teeth arranged to mesh with said stem setting pinion when the setting stem is in the engaged position, wherein the improvement comprises, a stem extension disposed beyond the stem setting pinion on said setting and extending along said first axis, said frame defining a bore housing said stem extension, whereby the end of the setting stem is supported by said frame, and wherein said toothed wheel is mounted on said spindle, said stem extension being arranged to move past said spindle without interfering therewith when the stem is moved axially in said frame, said setting stem including a pair of detenting grooves, and wherein said detent means comprises a spring biased detent portion arranged to enter said grooves and a yieldable support portion disposed on the side of said toothed wheel opposite said crown teeth said yieldable support portion being adapted to support the toothed wheel during engagement of the stem setting pinion, said stem setting pinion being disposed said between said second axis and said crown teeth, said first axis being arranged so that it is offset from said second axis to be non-intersecting therewith, and said crown teeth being skewed by a preselected angle away from the radial direction on said toothed wheel, whereby engagement of the stem setting pinion with the crown teeth is facilitated.

* * * * *